US005204204A

United States Patent [19]

Shintani et al.

[11] Patent Number: 5,204,204

[45] Date of Patent: Apr. 20, 1993

[54] CARRIER FOR DEVELOPING ELECTROSTATIC LATENT IMAGE

[75] Inventors: Yuji Shintani; Etsuaki Urano; Osamu Doi, all of Toyokawa; Shinobu Nakasawa, Toyohashi; Ichiro Demizu, Toyonaka; Miyoko Ito, Nagoya; Kazuhiro Itadaki, Amagasaki; Nobutaka Torii, Amagasaki; Yukio Tanigami, Amagasaki; Toshio Honjo; Yuji Sato, both of Kashiwa; Toshiyuki Fukumoto, Matsudo, all of Japan

[73] Assignees: Minolta Camera Kabushiki Kaisha, Osaka; Powdertech Co., Ltd., Kashiwa, both of Japan

[21] Appl. No.: 799,129

[22] Filed: Nov. 27, 1991

[30] Foreign Application Priority Data

| | | | |
|---|---|---|---|
| Nov. 30, 1990 | [JP] | Japan | 2-337543 |
| Nov. 30, 1990 | [JP] | Japan | 2-337544 |
| Apr. 9, 1991 | [JP] | Japan | 3-076031 |
| Apr. 9, 1991 | [JP] | Japan | 3-076032 |
| Jun. 5, 1991 | [JP] | Japan | 3-134124 |

[51] Int. Cl.[5] ..... G03G 9/10

[52] U.S. Cl. ..... 430/108; 430/137

[58] Field of Search ..... 430/108, 137, 109, 110

[56] References Cited

U.S. PATENT DOCUMENTS 5,102,769 4/1992 Creatura ..... 430/109

FOREIGN PATENT DOCUMENTS 52-154639 12/1977 Japan .
54-35735 3/1979 Japan .
2-79862 3/1990 Japan .
2-108069 4/1990 Japan .

*Primary Examiner*—John Goodrow
*Attorney, Agent, or Firm*—Burns, Doane, Swecker & Mathis

[57] ABSTRACT

This invention relates to a carrier for developing electrostatic latent images comprising;

carrier core particles having specified physical properties such as mean particle size, a bulk density, ratio of small particles, surface area index and the like, and resin-coating layers formed of specified components at specified content by a sintering process so that the layer resin may have specified physical properties such as ratio of integrated intensity and the like.

18 Claims, 1 Drawing Sheet

CARRIER FOR DEVELOPING ELECTROSTATIC LATENT IMAGE

BACKGROUND OF THE INVENTION

The present invention relates to resin-coated carriers used as a developer in combination with toner.

As electrostatic latent image development methods for electrophotography, two component development methods have been conventionally known in which development is carried out by transferring the developer to bring it into contact with an electrostatic latent image while the toner is frictionally charged by mixing an insulating non-magnetic toner with carrier particles.

One of the main function of the carrier is to frictionally charge the toner by making contact therewith.

To enhance the frictional charging ability of the carrier, it is an effective means to enlarge the surface area of the carrier, for example, by making the shape of the carrier irregular, forming fine concavities and convexities on the surface of the carrier or making its particle size small.

In magnetic materials such as ferrite used as the carrier, however, the so-called spent-toner phenomenon occurs when it is brought into contact with the toner to frictionally charge it for a prolonged period of time, because toner materials fuse on the surface of the carrier to reduce its effective surface area and therefore reduce its frictional charging ability. For this reason, the surface of the carrier is coated with a resin, which causes the degree of concavities and convexities on the carrier surface to be lessened, contrary to the purpose of enlarging the surface area. Thus, there remain the problems of durability, stability of charge for a prolonged period of time, and fogging of the toner unsettled. Use of a carrier with too small particle size causes some undesirable carrier phenomenon and adhesion of carrier, disadvantageously.

Recently color copying machines have been developed and carriers are used for the machines together with a light-transmittable color toner. Conventional charge controlling agents cannot be used in the light-transmittable color toner in such an amount as they have been used in a black toner because of the need of ensuring the light-transmittable property. This is due to the fact that the charge controlling agents are in most cases colored, which can impair the light-transmittable property of the toner. Accordingly, the carrier is required to have more advanced frictional charging characteristics in order to keep a certain level of charge amount with a less quantity of charge controlling agents.

SUMMARY OF THE INVENTION

The object of the present invention is to provide a carrier which is excellent in durability, charging stability and free from occurrence of toner fogging, carrier fogging, and the like.

The present invention relates to a carrier for developing electrostatic latent images, characterized in that the surface of carrier core particles having a mean particle size of 40 μm to 60 μm and a bulk density of 2.45 g/cm$^3$ to 2.65 g/cm$^3$ is coated with a resin and the amount of the coating resin is in the range of 2.7% by weight to 3.5% by weight on the basis of the carrier core particles.

DETAILED DESCRIPTION OF THE INVENTION

Figure 1:
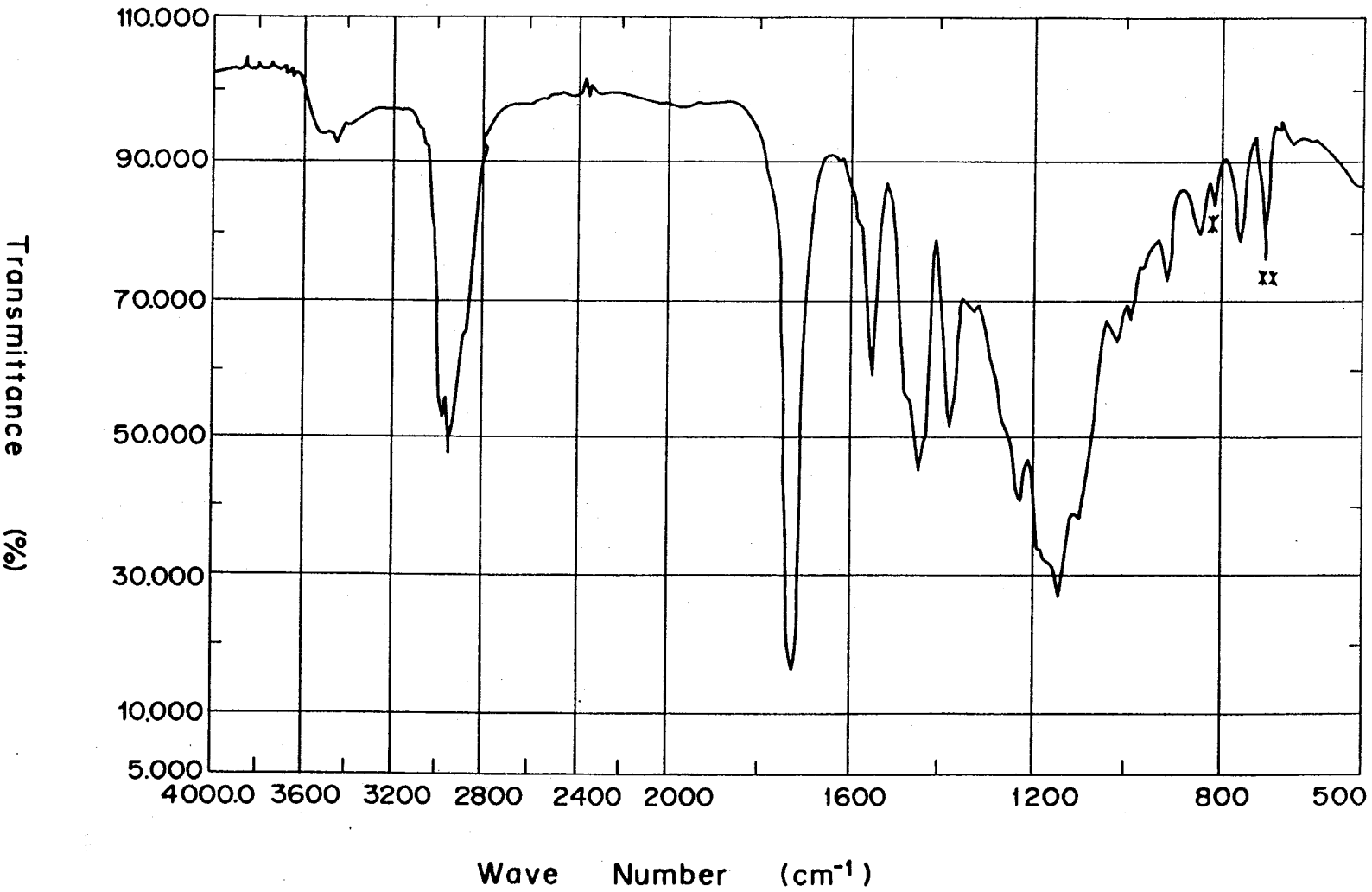
FIG. 1 shows FT-IR spectrum of soluble components of resin layer.

The present invention provides a carrier which is excellent in durability, charging stability and free from occurrence of toner fogging, carrier fogging, and the like.

The objects of the present invention can be achieved by a carrier comprising;

specified carrier core particles, and specified resin-coating layers.

The first invention relates a carrier for developing electrostatic latent images comprising;

carrier core particles having a mean particle size of 40 to 60 μm and a bulk density of 2.45 to 2.65 g/cm$^3$, and resin-coating layers the amount of which is 2.7 to 3.5% by weight on the basis of the carrier core particles.

The carrier above is excellent in ability to charge toner and can be effects prevention of toner dust, stabilization of image density and formation of copied images of fine texture as well as prevention of toner fogs and carrier fogs.

As the carrier core particles, known carriers are applicable including metals such as ferrite, magnetite, iron, nickel and cobalt; alloys or admixtures of these metals with other metals such as zinc, antimony, aluminum, lead, tin, bismuth, beryllium, manganese, selenium, tungsten, zirconium and vanadium; admixtures of these metals with metal oxides such as metal oxides such as iron oxide, titanium oxide and magnesium oxide, with nitrides such as chromium nitride and vanadium nitride, with carbides such as silicone carbide and tungsten carbide; and ferromagnetic ferrite and admixtures of them.

Among these carrier core particles, those which have a mean particle size of 40 to 60 μm, preferably 45 to 55 μm, and a bulk density of 2.45 to 2.65 g/cm$^3$, preferably 2.50 to 2.60 g/cm$^3$ are used in the present invention.

When the mean particle size of the carrier core particles is over 60 μm, there appears roughness in copied images and stripes due to the magnetic brush, resulting in deteriorated copied images. When carrier core particles having a mean particle size of less than 40 μm are used, on the other hand, magnetic force is weakened, making it more likely for the carrier to adhere onto the copied images and copy ground.

Particles having a mean particle size in the range of 40 to 60 μm and a bulk density in the range of 2.45 to 2.65 g/cm$^3$ are used as carrier core particles. When the bulk density is over 2.65 g/cm$^3$, irregularities of the particle is diminished to cause a poor charging ability to toner. When the bulk density is below 2.45 g/cm$^3$, the adhesion of carrier particles is liable to occur due to the decrease of magnetic force.

The degree of irregularity on the surface of carrier core particles made of ferrites is determined by a sintering temperature in a manufacturing process of the ferrite. The higher the sintering temperature is, the larger the particle size of the metal oxides constituting ferrite particles and the less the concaves and convexes on the surface are decreased, resulting in a smoother surface. In contrast, the lower the sintering temperature is, the smaller the particles of the metal oxides is and the finer the concaves and convexes will appear on the surface. This means that ferrite particles with a smooth surface are packed more densely and have a larger bulk density while ferrite particles with finer irregularities on their surface are packed more thinly and have a smaller bulk density. To heighten the charging ability of ferrite particles, it is advantageous that the bulk density is made smaller and the surface area is made larger.

When the bulk density is too small, however, the amount of magnetic materials in one particle is reduced and magnetic force is weakened, so that the particles are made liable to adhere to photosensitive members. Therefore, bulk densities may not be made smaller than a certain value, practically.

Resins to be used for coating the carrier core particles are, for example, various kinds of thermoplastic and thermosetting resins such as polystyrenes, poly(metha)-acrylic resins, polyolefins, polyamides, polycarbonates, polyethers, polysulfones, polyesters, epoxy resins, polybutyrals, ureas, urethane/urea resins, silicones, polyethylenes and Teflons and their mixtures, and copolymers, block polymers, graft polymers and polymer blends of these resins. In addition, various resins having polar groups may also be used to improve charging property.

Particularly, when toner constituting resins which are used in combination with carriers are composed of polyesters, the toner has a property to be charged negatively. Therefore, it is preferable to use thermosetting acrylic resins to make the carrier to be positively charged. The preferable thermosetting acrylic resins include homopolymers of acrylic monomers, or copolymers of acrylic monomers themselves or with styrene monomers which are cross-linked with melamine compounds or isocyanate compounds. Alkyl esters of methacrylic acid such as methyl methacrylate, butyl methacrylate, octyl methacrylate and stearyl methacrylate; alkyl esters of acrylic acid such as ethyl acrylate, propyl acrylate, butyl acrylate and octyl acrylate; acrylonitrile and acrylamide; or vinyl monomers containing amino groups such as dimethylaminoethyl ester of methacrylic acid, diethylaminoethyl ester of methacrylic acid, dimethylaminoethyl ester of acrylic acid and dimethylaminopropyl methacrylamide can be used as acrylic monomers, and styrene, α-methylstyrene, vinyltoluene, p-ethylstyrene and the like can be used as styrene monomers.

In the present invention, carrier core particles are coated with the above-described resins in a ratio of 2.7 to 3.5% by weight, preferably 2.9 to 3.3% by weight, on the basis of the weight of carrier core particles.

The carrier core particles having a mean particle size of 40 to 60 μm and a bulk density of 2.45 to 2.65 g/cm$^3$ have fine irregularities, so that resins will permeate into concavities on the surface of particles when the particles are coated with the resin. Therefore, when the amount of coating resin is less than 2.7% by weight, the surface of particles cannot be coated with the resin completely, leaving the non-coated surface of the particle partly exposed. As a result, the fusion of toner is more likely to occur to the exposed surface. The durability life of the carrier is diminished. Charge leakage through the exposed part is also likely to occur which makes texture of copied images poor. When the amount of coating resin exceeds 3.5% by weight, on the other hand, there occurs a manufacturing problem that carrier particles are liable to aggregate each other in coating the carrier or other problems.

A solution containing the above-mentioned coating resin in an appropriate solvent is used for coating the carrier particles with the resin, by means of an immersing method or a spray-drying method.

The coated particles are dried after coating, and they are subjected to a sintering treatment, if necessary.

When a thermosetting resin is used for the coating resin, for example, the sintering process is carried out at a temperature of more than thermoset-starting temperature plus 30° C. for an appropriate time. A temperature of 120° C. or so is sufficient to initiate thermosetting reaction for the thermosetting resin used for coating the carrier particles.

Since the carrier particles are aggregated into a bulky state after sintering, a carrier with a desired particle size can be obtained by crushing the bulk followed by classifying.

The above-described coating, sintering, crushing and classifying are repeated to obtain a sufficient thickness of the coating resin.

The above process is defined as "first sintering" in the present invention for convenience.

It is preferable to subject the resin-coated carrier obtained by the first sintering to further sintering treatment. This sintering after the first sintering is defined as "second sintering".

The second sintering is carried out at a temperature higher than the temperature of the first sintering and lower than the temperature of first sintering temperature plus 50° C., preferably from the temperature of first sintering temperature plus 10° C. to the temperature of first sintering temperature plus 40° C., more preferably from the temperature of first sintering temperature plus 20° C. to the temperature of first sintering temperature plus 40° C. When the sintering temperature is higher than the temperature of first sintering temperature plus 50° C., the resin itself constituting the coating layer is decomposed, and the coating layer is made fragile, so that it may easily be peeled. Depending on the temperature at which it is done, the second sintering is sufficiently effected in 1 to 5 hours.

The second sintering is carried out besides the first sintering because, if the first sintering is carried out at such a high temperature as is applied to the second sintering, the resin-coating layer obtained is liable to be peeled and poor in durability, so that it is difficult to ensure a sufficient charging stability. With thermosetting resins, in particular, if the first sintering process was carried out at such a high temperature, monomer components would be scattered off during the sintering, possibly resulting in an insufficient degree of cross-linkage.

Composition stability and heat stability of the carrier coating resin are improved by this second sintering, which in turn produces such effects as stabilization in charging ability, improvement in heat resistance and durability, as well as prevention of spent toner and toner fogs. These effects can be considered to be due to enhancement of cross-linkage which is done insufficiently by the first sintering only, as well as due to elimination of non-cross-linked components, solvents and catalysts which are remaining in the coating layer, both of which are effected by the second sintering.

When the coating, sintering and crushing processes are carried out repeatedly in the first sintering process, it is allowable to subject the sintered carrier particles to the second sintering process successively upon completion of the last sintering process by raising the temperature to the second sintering one without crushing the carrier particles. However, it is desirable that the carrier particles over the first sintering are crushed and made uniform in particle size to a predetermined one before being subjected to the second sintering. This is because insufficient cross-linking is enhanced to form a complete cross-linking since the surface area of carrier particles is made larger and heat treatment efficiency is made higher, as well as non-cross-linking components in the coating layer, solvents and catalysts become easy to be eliminated and the crushing process after the sintering treatment also becomes easy to be carried out.

Carriers according to the present invention have preferably a heat decomposition peak temperature of 275° C. or more. When the temperature of heat decomposition is lower than 275° C., heat resistance of the carrier is deteriorated and a blocking phenomenon is made liable to occur. Resin-coated carriers according to the present invention also have a bulk density of from 2.35 to 2.55, preferably from 2.40 to 2.50.

The objects of the present invention can be also achieved by a resin-coated carrier with a resin layer of specified uniformity. The uniformity is referred to as the number of adsorbed molecules n (molecules/nm$^2$) of carbon dioxide ($CO_2$) per unit area represented by the following equation:

$$n = \frac{(CO_2)(ml/g) \times (A)(molecules/mole)}{(22414)(ml/mole) \times (N_2)(cm^2/g) \times (10^{18})(nm^2/cm^2)}$$

wherein ($CO_2$) represents an adsorbed amount of $CO_2$ in monomolecular layer (ml/g); (A) represents $6\times10^{23}$ (molecules/mol)); ($N_2$) represents $N_2$ specific surface area (cm$^2$)

In the present invention, the values ($n_1$) and ($n_2$) before and after coating the carrier with the resin, respectively, satisfy the following relation:

$$n_2/n_1 \geqq 20.$$

The uniformity of the coating resin on the surface of carrier is specified in the present invention by the ratio $n_2/n_1$ of the values ($n_1$) and ($n_2$) before and after coating the carrier with the resin, respectively, when the number of adsorbed molecules of carbon dioxide ($CO_2$) per unit area is expressed by n (molecules/nm$_2$) as shown in equation (I).

The term "$N_2$ specific surface area (cm$^2$/g)" in equation (I) means a value calculated from an adsorption isothermal line of nitrogen ($N_2$) gas by using the BET equation.

Since $N_2$ molecules are adsorbed uniformly on the surfaces of both the carrier itself and the coating resin, specific surface area of the carrier particle before and after coating can be calculated precisely.

The term "Adsorbed amount of $CO_2$ in monomolecular layer (ml/g)" means a value calculated from an adsorption isothermal line of carbon dioxide ($CO_2$) gas by using the BET equation.

Although $CO_2$ molecules can hardly be adsorbed on the surface of the carrier itself before coated with the resin, it can be adsorbed on the surface of the coating resin uniformly. Therefore, the number of adsorbed $CO_2$ molecules can be determined from the adsorbed amount and, by combining the specific surface area determined by the $N_2$, the comparison of resin-coated degree is made possible.

The term "$6\times10^{23}$ (molecules/mol)" denotes Avogadro's number.

The term "22414 (ml/mol)" denotes a volume (ml) per one mole of molecule in the standard state.

A value of more than 20 for $n_2/n_1$, preferably more than 10 and less then 70, is required in the present invention for the uniformity of the coating resin on the surface of carrier to attain the object of the present invention. When the value is below 20, the coating of carrier is considered to be non-uniform. In this case, the coating amount is insufficient and the surface of carrier particle is exposed partially. As the coating amount is large, the value of $n_2/n_1$ becomes also large. When the value is more than 70, the carrier particles become liable to aggregate.

The coating amount is 2.7 to 3.5% by weight, preferably 2.9 to 3.3% by weight on the basis of the weight of carrier core particles. The following cautions should be taken in carrying out the coating treatment to attain the ratio of $n_2/n_1 \geqq 20$ of the number of adsorbed $CO_2$ before and after the carrier particles are coated with a resin.

(1) Coating treatment is divided into many times so that the predetermined coating amount is satisfied. It is desirable to limit the coating amount in one treatment to $\frac{1}{3}$ or less of the total coating amount.

(2) The coating amount is made to decrease as the number of times of the coating treatment increases. It is preferable to decrease the coating amount of resin, especially in the case of ferrite having a bulk density of 2.6 g/cm$^3$ or less. More preferably, the amount of the coating resin in the final coating treatment process is $\frac{1}{2}$ or less of the average one of each process.

Next, another embodiment of the present invention is described below.

Carrier aggregation are liable to appear in the process of coating the carrier particles with resin. These aggregates are crushed by stirring or the like in practical use and surfaces of the carrier core particles are exposed, causing problems of lowered resistance and adhesion of the carrier onto the surface of the photosensitive member. The adhering carrier causes voids on copied images or is transferred thereto as it is.

These problems can be solved by a carrier for developing electrostatic latent images, formed by coating with a resin the surface of carrier particles composed of small particles of 31 μm or less at a content of 10 volume % or less and having a mean particle size in the range from 40 μm to 60, bulk density of 2.45 g/cm$^3$ to 2.65 g/cm$^3$, a amount of the coating resin of 2.7% by weight to 3.5% by weight on the basis of the weight of the carrier core particles, in which the ratio of change of the particles with a large particle size of 62 μm or more is less than 100% when it is expressed by the following equation [I]:

$$(B-A)/A \qquad [I]$$

[wherein A denotes the proportion (%) of the carrier core particles having a particle size of larger than 62 μm while B denotes the proportion (%) of the carrier particles having a particle size of larger than 62 μm after coated with the resin].

Carrier core particles composed of small particles smaller than 31 μm at the content of less than 10 volume % and having a mean particle size in the range from 40 to 60 μm, preferably from 45 to 55 μm and bulk density of 2.45 to 2.65 g/cm$^3$, preferably 2.50 to 2.60 g/cm$^3$.

Small particles having a particle size of less than 31 μm are liable to aggregate in the following resin-coating process, and the aggregates and the crushed aggregates cause carrier fogs, adhesion of carrier to a photosensitive member and occurrence of voids on copied images. These problems can be prevented by using carrier core particles composed of small particles at the content of less than 10%, preferably less than 8% to 7%. Particularly, the proportion of small particles having a particles size of less than 31 μm is made 10% or less from the requirement that the increase of the particles having a particle size of more than 62 μm should be limited within a specified range, as described hereinafter, since even the small particles having a particle size of less than 31 μm aggregate to have a particle size of 62 μm or more. When the proportion exceeds more than 10%, the aggregation of carrier occurs during the resin-coating process and the aggregates having a particle size of more than 62 μm increase, so that problems of decrease in amount of charge, increase of flying toner and occurrence of fogs on the copy ground are brought about.

Those carriers are used, wherein the ratio of increment of large particles having a particle size of more than 62 μm before and after coating with the resin is less than 100% when the ratio is expressed by the following equation:

$$(B-A)/A \qquad [I]$$

[wherein A denotes the proportion (%) of the carrier core particles having a particle size of more than 62 μm while B denotes the proportion (%) of the carrier particles having a particle size of more than 62 μm after coated with the resin].

The use of such a carrier results in prevention of aggregation of carrier, prevention of decrease of effective specific surface area and improvement of charging ability. When the ratio of increase exceeds 100%, the aggregates of carrier increase and are crushed during the practical use to produce many fine particles the surface of which is exposed and which are lowered in electrical resistance. This brings about another problems of occurrence of flying toner due to insufficient charge amount, increment in fogs on copy ground and adhesion of the carrier particles onto the surface of a photosensitive member.

A further embodiment, in which a coating layer comprising acrylic-styrene resins and melamine resins which are able to react with the acrylic-styrene resins to form cross-linkages is, is described below.

The inventors have found, through intensive studies, that the durability of carrier relates to a ratio of integrated intensity of the unreacted portion of melamine resins to the unreacted portion of the acrylic-styrene resin as measured by FT-IR. Moreover, the inventors also found that, when the ratio of the integrated intensity between the unreacted portion of the melamine resins and styrene components in the unreacted portion of the acrylic-styrene resins is in the range from 0.05 to 0.50, the durability of carrier is improved remarkably as compared to that of conventional carriers.

Accordingly, the present invention also provides a carrier for developing electrostatic latent images comprising;

a carrier core material and a coating layer comprising an acrylic-styrene resin and a melamine resin which is able to cross-link the acrylic-styrene resin to form crosslinkages, the ratio of the integrated intensity between unreacted melamine components and unreacted styrene components in acrylic-styrene resin in the coating layer being in the range of 0.05 to 0.50.

The ratio of the integrated intensity in the copolymer of acrylic-styrene resin with melamine resin in the present invention refers to a value determined by the steps of: immersing the coated carrier in a solvent (methylethylketone and the like); filtrating the carrier thereafter; examining the filtrated solution containing unreacted resin components by means of FT-IR through a transmittance method to observe the integrated intensity of each characteristic absorbance band of melamine and styrene in acrylic-styrene resins and dividing the integrated intensity of melamine (Im) by that of styrene (Is), which is expressed by the following equation:

$$\text{Ratio of Integrated Intensity} = \frac{Im}{Is}$$

wherein Im means integrated intensity of melamine, and Is means integrated intensity of styrene.

For example, in the case where carrier core particles are coated with a solution prepared by mixing 78% by weight of acrylic styrene resin composed of styrene - methyl methacrylate - 2-hydroxyethyl methacrylate - polyether polyol (constitution ratio 10:57:12:6:15) with 22% by weight of hexamethoxymethylol melamine resin as a melamine so that the coating ratio may be at 3.0 % by weight on the basis of the carrier core particles, and are sintered at 160° C. for 5 hours, the characteristic absorbance band of styrene in the acrylic-styrene resin is at 702 cm$^{-1}$ which belongs to CH out-of-plane deformation vibration of benzene ring. The value of the integrated intensity in this case was Is=1.518 (the integrated intensity from 725.1 to 680.7 cm$^{-1}$). Specific absorbance band of melamine is at 815 cm$^{-1}$, which belongs to a frame vibration of triazine ring. The integrated intensity was Im=0.299 (integrated intensity from 829.2 to 800.3 cm$^{-1}$). The ratio of integrated intensity (Im/Is) is calculated as follows:

$$Im/Is = \frac{0.029}{1.518} = 0.20$$

A chart of FT-IR of the above example is shown in FIG. 1. In FIG. 1, the mark (*) indicates a frame vibration of triazine ring in the melamine resin. The mark (**) indicates C-H out-of-plane deformation vibration of benzene ring of the acrylic-styrene resin.

The ratio of the integrated intensity of the unreacted melamine resin in the coating layer to that of styrene in the unreacted acrylic-styrene resin is preferably in the range from 0.05 to 0.50, and the value of 0.10 to 0.30 is particularly preferable. Control of this ratio of the integrated intensities is possible by adjusting the temperature and time in a sintering process depending on the constituents of the resin and the kind of the resin.

When the ratio of integrated intensity is below 0.05, environmental resistance is poor and concentration of copied images decreases largely by the increase of amount of charge, since excessive accumulation of charge occurs during repeated copy under the condition of low temperature and low humidity. Moreover, the coating layer on the surface of carrier is hardened because of excessive cross-linking of the melamine reins. The photosensitive member may be damaged and the quality of copied images may be deteriorated when copy process is repeated.

When the ratio of integrated intensity is over 0.50, the coating layer on the surface of carrier becomes too soft due to much amount of unreacted component of the melamine resin. The surface layer of carrier is liable to be peeled off and toner particles may adhere to the peeled-off surface of the carrier. Toner is spent to make the life of carrier short. Under the conditions of high temperature and high humidity, large particles appear by a blocking phenomenon among the carrier particles and the particles are stacked between at a doctor blade and a sleeve on a magnet roller in the development box. The flow of the developer is interfered, so that some toner particles will not be transferred appropriately to a photosensitive member. This may cause deficiencies of copied images. When the situation described above proceeds further, some carrier particles may be scattered off in the apparatus to damage a photosensitive member.

The effects of the carrier having specified ratio of integrated intensity as above mentioned can be also achieved by a carrier comprising;

carrier core particles having a surface area index of the carrier core of 2.2 to 5.2, resin layers comprising 5 to 30% by weight of acrylic-styrene resin composed of at least one kind of acrylic acids or methacrylic acids, and acrylic acid esters or methacrylic esters containing functional groups (referred to as functional acrylic acid esters or methacrylic acid esters) and 10 to 35 % by weight of melamine resin.

The surface area index in the present invention is represented by a value of the specific surface area as measured by the BET method divided by the specific surface area obtained by an air-permeation method. The surface area index is one of barometers for controlling the carrier surface property. Specific surface area by the BET method allows not only measurement of the concave and convex portions on the surface of the carrier core material but also that of the pores in the interior of the carrier core material continuously formed from the surface by replacing with $N_2$ gas. Therefore, this value is a suitable measuring method to calculate the coating amount when resistance is controlled in the coating resin. Measurement of specific surface area by the air-permeation method is a method in which the time required for air to permeate the carrier filled in a cell is measured to obtain specific surface area. The method is suited for measuring the area relatively limited to the surface area of carrier core material.

Therefore, the surface area index can be expressed by calculating both values of the specific surface area mentioned above by the following equation:

Surface area index = Specific surface area by BET method ($cm^2/g$) / Specific surface area by air-permeation method ($cm^2/g$).

An apparatus of Flow-Sorb II 2300 made by Shimadzu Seisakusho K. K. or the like can be used for measuring the specific surface area by BET. An apparatus of SS-200 made by Shimadzu Seisakusho K. K. or the like is appropriate for the measurement of the specific surface area by the air-permeation method.

Preferable surface property of the carrier core material in the present invention is in the range of 2.2 to 5.2, as measured by a surface area index, and the value of 2.5 to 4.5 is particularly preferable.

When the surface area index is less than 2.2, the surface is so smooth that a resin layer can be easily formed. The resin layer is, however, peeled off easily by stirring the developer. Toner particles adhere to the peeled-off layer, i.e. the exposed parts of core material. A spent toner phenomenon appears in the early stage, so that the life of developer is diminished.

When the surface area index is over 5.2, a larger amount of resins is needed to form a resin layer uniformly on the surface of carrier since the strength of carrier core material is weak. This makes the production cost high. Further, it becomes more difficult to form a uniform coating layer of resin on the surface of carrier core. Even when a uniform resin layer can be formed, a carrier becomes insulative because the interior of carrier core material is filled with a large amount of resin. The accumulation of charge increases under the conditions of low temperature and low humidity. The stable concentration of copied image can not be kept.

Examples of styrenes used for the acrylic-styrene resin according to the present invention are styrene, o-methylstyrene, m-methylstyrene, p-methylstyrene, p-ethylstyrene, 2,4-dimethyl-styrene, p-n-butylstyrene, p-tert-butylstyrene and p-n-decyl-styrene.

Functional acrylic esters or methacrylic esters are exemplified by acrylic acid and methacrylic acid, 2-hydroxyethyl acrylate, 2-hydroxypropyl acrylate, 2-hydroxyethyl methacrylate, and 2-hydroxypropyl methacrylate. Monoester of acrylic acid/polyethyleneglycol, monoester of acrylic acid/polypropyreneglycol, monoester of methacrylic acid/polyehtyleneglycol and monoester of methacrylic acid/glycol, or even polyester polyols such as glycerine/polypropyreneoxide adduct are also used. Preferable molecular weight of this acrylic acid/polyethyleneglycols or polyether/polyols is less than 3000, particularly about 1000 is preferable.

Preferable content of the functional acrylic acid esters or methacrylic acid esters required to form a cross-linkage with a melamine resin is 5 to 30% by weight in the coating layer, and the value of 10 to 25% by weight is particularly preferable. When the content is less than 5% by weight, the amount of carboxylic or hydroxyl groups to be cross-linked with the melamine resin is so small that a tough coating layer is difficult to be formed. When the content is more than 30% by weight, a sufficient amount of melamine resin is required. When the cross-linking reaction is insufficient, unreacted hydroxyl groups, carboxyl groups or melamine resin remain in a large amount, resulting in deterioration of environmental stability. When all the reactive groups have reacted, copied images of high quality is hardly obtained due to the increased amount of charge under conditions of low temperature and low humidity.

Melamine resins used in the present invention are trimethylol melamine, hexamethylol melamine, trimethoxymethylol melamine, hexamethoxymethylol melamine, triisopropanol melamine, hexaisopropanol melamine, trimethoxyisopropanol melamine, hexamethoxyisopropanol melamine, tributanol melamine, hexabutanol melamine, trimethoxybutanol melamine, hexamethoxybutanol melamine, triisobutanol melamine, hexaisobutanol melamine, trimethoxyisobutanol melamine and hexamethoxyisobutanol melamine.

Preferable content of the melamine resin is 10 to 35% by weight on the basis of the acrylic-styrene resin, and particularly preferable is 15 to 30% by weight. The content of the melamine resin is preferably above, particularly at least 5% by weight more than the content of the functional acrylic acid esters or methacrylic acid esters in the acrylic-styrene resin. When the content of the melamine resin is less than 10% by weight, a tough coating layer is difficult to be formed. When the content is more than 35% by weight, an amount of the functional acrylic acid esters or methacrylic acid esters is required to react with the melamine resins. When the degree of cross-linking reaction is insufficient, unreacted hydroxyl groups, carboxyl groups or melamine resin remain in a large amount, resulting in the deterioration of environmental stability. When all the functional groups have been treated, charge amount increases under low temperature and low humidity.

When the content of the melamine resin is less than the content of the functional acrylic acid esters or methacrylic acid esters in the acrylic-styrene resin, a tough resin-coating layer are difficult to be formed in a sintering process.

Solvents to be used for forming a coating layer of the present invention are exemplified by toluene, xylene, cellosolve butyl acetate, methylethyl ketone, methylisobutyl ketone and methanol.

Coating layers on the carrier core material are formed by coating the carrier core material with the above-described acrylic-styrene resin and melamine resin dissolved in a solvent by using an immersing method, a spray method or a brushing method. After dried to remove the solvent, the coated carrier is baked. Baking temperature is usually 100° to 195° C. but a temperature of 140° to 190° C. is preferable. Selection of the baking temperature in accordance with the kind of the resin is important to keep the integrated intensity in the range of 0.05 to 0.50. It is inevitable that a part of the acrylic resin is decomposed at a baking temperature of 200° C. or higher. In such a case, the integrated intensity may become below 0.05. When the baking temperature is below 140° C., the integrated intensity may exceed 0.50.

In the baking process, it is preferable to apply both the first sintering process and the second sintering process as described above.

The carrier of the present invention is used as a two component developer in combination with toner.

Details of the present invention are described referring to the examples.

PRODUCTION OF TONER

Binder Resin: Production of Vinyl Modified Polyester

Sixty eight parts by weight of polyoxyethylene(2)-2,2-bis(4-hydroxyphenyl)propane, 16 parts by weight of isophthalic acid, 16 parts by weight of terephthalic acid, 0.3 parts by weight of maleic anhydride and 0.06 parts by weight of dibutyl tin oxide were placed in a flask and treated at 230° C. for 24 hours in nitrogen atmosphere. A polyester resin containing unsaturated polyester was obtained.

Weight average molecular weight of the polyester obtained was 10,600.

Fifty parts by weight of this polyester was dissolved in 50 parts by weight of xylene in a flask. The temperature was raised to a refluxing temperature of xylene. As xylene was refluxed, a solution of 0.4 parts by weight of azobisisobutylonitrile in 13 parts by weight of styrene and 2 parts by weight of methyl methacrylate was added dropwise in 30 minutes in nitrogen atmosphere. After the addition, the temperature was kept for 3 hours. After xylene was distilled in vacuum, the resin was taken out to obtain a binder resin having a weight average molecular weight of 13,100, a melting viscosity at 100° C. of $6\times10^4$ poise and a glass transition temperature of 63° C.

The melting viscosity was measured by means of a flow test meter CFT-500 made by Shimadzu Seisakusho K. K. under the measuring conditions of a nozzle diameter of 1 mm, a nozzle length of 1 mm, a loading weight of 30 kg, a temperature increase rate of 3° C./min.

| | Parts by weight |
|---|---|
| Styrene-acrylic modified polyester resin obtained above | 100 |
| Carbon black | 3 |
| MA#8 (made by Mitsubishi Kasei K.K) | 3 |
| Charge controlling agent (Bontron E-84, made by Orient Kagaku K.K.) | 3 |

The above-described materials were mixed thoroughly, kneaded in a two-axis extruder, and cooled. After the obtained mixture was roughly pulverized by a feather mill, particles having a particle size of 5 to 25 μm (mean particle size: 10.5 μm) were obtained by using a jet crusher and an air classifier.

Then, the obtained particles were mixed with 1.0% by weight of hydrophobic titanium (T-805; made by Nihon Aerosil K. K.) and 0.2% by weight of hydrophobic silica (H2000/4; made by Wacker K. K.) in a Henschel mixer to obtain a toner.

EXAMPLE 1

Sintered copper-zinc ferrite powder (F-300; mean particle size: 45 μm, bulk density: 2.50 g/cm$^3$; made by Powdertech Co., Ltd.) was used as a core material. The powder was coated with a solution of styrene-acrylic resin described below by using SPIRA COTA (made by Okada Seiko K. K.), followed by drying. The carrier obtained was sintered in a hot-air circulating oven for 2 hours at 140° C. After cooled, the ferrite powder bulk was pulverized and classified by a classifier with screen meshes having openings of 210 μm and 90 μm. Thus, a ferrite powder coated with the resin was obtained. The coating, sintering, and pulverizing and classifying processes described above were repeated 4 times more to the resulting ferrite powder (first sintering).

The ferrite powder obtained in the first sintering process was sintered again in the above-described oven at 170° C. for 2 hours (second sintering). After cooled, the ferrite bulk was pulverized and classified as described above to obtain a resin-coated carrier. Mean particle size, amount of coating resin (Rc), heat decomposition peak temperature and electric resistance of the carrier obtained were 49 μm, 3.42%, 291° C., and about $5\times10^{10}\Omega$ cm, respectively.

Preparation of Resin Solution

Eighty parts by weight of styrene-acrylic copolymer composed of styrene, methyl methacrylate, 2-hydroxyethyl acrylate and methacrylic acid (1.5:7:1.0:0.5) and 20 parts by weight of butylated melamine resin were diluted with toluene to obtain a solution of styrene-acrylic resin with a solid fraction of 2%.

The amount of coating resin (Rc) was determined as follows.

About 5 g of the resin-coated carrier is placed in a 10 cc crucible the weight $W_0$ (g) of which has previously been measured precisely, and total weight $W_1$ (g) is measured. The crucible is placed in a muffle oven. The temperature is raised to 900° C. at a temperature increase rate of 15° C./min., the crucible is allowed to stand for 3 hours with the temperature kept at 900° C. to burn up the coating resin, and then cooled to room temperature. Immediately after the temperature has reached room temperature, the weight $W_2$ (g) of the crucible with the carrier in it is weighted precisely. The amount of the coating resin (Rc) can be calculated by the following equation:

$$Rc\,(\%) = \frac{W_1 - W_2}{W_2 - W_0} \times 100$$

Particle size of the carrier was measured by using a particle size distribution analyzer of laser diffraction type made by Microtrack K. K.

Bulk density of the carrier was obtained by a bulk density measuring apparatus made by Kuramochi Kagaku Kikai Seisakusho K. K. according to JIS Z 2504.

Heat decomposition peak temperature was obtained from a DSC curve by using a thermoanalyzer (SSS-5000 made by Seiko Denshi K. K.).

EXAMPLE 2

Sintered copper-zinc ferrite powder (F-300; mean particle size: 55 μm, bulk density: 2.60 g/cm$^3$; made by Powdertech Co., Ltd.) was used as a core material, and the powder was coated with the solution of styrene-acrylic resin described above by using a SPIRA COTA (made by Okada Seiko K. K.), followed by drying. The carrier obtained was sintered in a hot-air circulating oven for 2 hours at 140° C. After cooled, the ferrite powder bulk was pulverized and classified by a classifier with screen meshes having openings of 210 μm and 90 μm. Thus, a ferrite powder coated with the resin was obtained. The coating, sintering, and pulverizing and classifying processes described above were repeated 3 times more to the resulting ferrite powder (first sintering).

The ferrite powder obtained in the first sintering process was sintered again in the above-described oven at 170° C. for 3 hours (second sintering). After cooled, the ferrite powder was pulverized and classified as described above to obtain a resin-coated carrier. Mean particle size, amount of coating resin (Rc), heat decomposition peak temperature and electric resistance of the carrier obtained were 57 μm, 2.94%, 295° C., and about $4\times10^{10}\Omega$ cm, respectively.

COMPARATIVE EXAMPLE 1

The same sintered ferrite powder (F-300; mean particle size: 45 μm, bulk density: 2.50 g/cm$^3$; made by Powdertech Co., Ltd.) as in Example 1 was used as a core material. The powder was coated with the same solution of styrene-acrylic resin described in Example 1 using SPIRA COTA (made by Okada Seiko K. K.), followed by drying. The carrier obtained was sintered in a hot-air circulating oven for 2 hours at 140° C. After cooled, the ferrite powder bulk was pulverized and classified by a classifier with screen meshes having openings of 210 μm and 90 μm. A ferrite powder coated with the resin was obtained. The coating, sintering, and pulverizing and classifying processes described above were repeated once more to the resulting ferrite powder to obtain a resin-coated carrier.

Mean particle size, amount of coating resin (Rc), heat decomposition peak temperature and electric resistance of the carrier obtained were 46 μm, 2.50%, 225° C., and about $9\times10^{9}\Omega$ cm, respectively.

COMPARATIVE EXAMPLE 2

Sintered copper-zinc ferrite powder (F-300; mean particle size: 45 μm, bulk density: 2.35 g/cm$^3$; made by Powdertech Co., Ltd.) was used as a core material, and the powder was coated with the same solution of styrene-acrylic resin described in Example 1 using SPIRA COTA (made by Okada Seiko K. K.), followed by drying. The carrier obtained was sintered in a hot-air circulating oven for 2 hours at 140° C. After cooled, the ferrite powder bulk was pulverized and classified by a classifier with screen meshes having openings of 210 μm and 90 μm to obtain a ferrite powder coated with the resin. The coating, sintering, and pulverizing and classifying processes described above were repeated 2 times more to the resulting ferrite powder to obtain a resin-coated carrier.

Mean particle size, amount of coating resin (Rc), heat decomposition peak temperature and electric resistance of the carrier obtained were 47 μm, 2.80%, 222° C., and about $7\times10^{9}\Omega$ cm, respectively.

COMPARATIVE EXAMPLE 3

Sintered copper-zinc ferrite powder (F-300; mean particle size: 55 μm, bulk density: 2.80 g/cm$^3$; made by Powdertech Co., Ltd.) was used as a core material, and the powder was coated with the same solution of styrene-acrylic resin described in Example 1 using SPIRA COTA (made by Okada Seiko K. K.), followed by drying. The carrier obtained was sintered in a hot-air circulating oven for 2 hours at 140° C. After cooled, the ferrite powder bulk was pulverized and classified by a classifier with screen meshes having openings of 210 μm and 90 μm to obtain a ferrite powder coated with the resin. The coating, sintering, pulverizing and classifying processes described above were repeated 2 times more to the resulting ferrite powder to obtain a resin-coated carrier.

Mean particle size, amount of coating resin (Rc), heat decomposition peak temperature and electric resistance of the carrier obtained were 59 μm, 2.92%, 225° C., and about $7\times10^{10}\Omega$ cm, respectively.

COMPARATIVE EXAMPLE 4

Sintered copper-zinc ferrite powder (F-300; mean particle size: 65 μm, bulk density: 2.53 g/cm$^3$; made by Powdertech Co., Ltd.) was used as a core material, and the powder was coated with the solution of a styrene-acrylic resin described below using SPIRA COTA (made by Okada Seiko K. K.), followed by drying. The carrier obtained was sintered in a hot-air circulating oven for 2 hours at 140° C. After cooled, the ferrite powder bulk was sintered, pulverized and classified by a classifier with screen meshes having openings of 210 μm and 90 μm to obtain a ferrite powder coated with the resin. The coating, sintering, pulverizing and classifying processes described above were repeated 2 times more to the resulting ferrite powder.

Mean particle size, amount of coating resin (Rc), heat decomposition peak temperature and electric resistance of the carrier obtained were 67 μm, 2.90%, 225° C., and about $4\times10^{10}\Omega$ cm, respectively.

EXAMPLE 3

Sintered copper-zinc ferrite powder (F-300; mean particle size: 45 μm, bulk density: 2.62 g/cm$^3$; made by Powdertech Co., Ltd.) was used as a core material, and a resin-coated carrier was obtained by the same method as in Example 1, except that the coating, sintering, pulverizing and classifying processes were repeated 3 times in the first sintering process. Mean particle size, amount of coating resin (Rc), heat decomposition peak temperature and electric resistance of the carrier obtained were 49 μm, 3.41%, 295° C., and about $8\times10^{10}\Omega$ cm, respectively.

EXAMPLE 4

Sintered copper-zinc ferrite powder (F-300; mean particle size: 45 μm, bulk density: 2.47 g/cm$^3$; made by Powdertech Co., Ltd.) was used as a core material, and a resin-coated carrier was obtained by the same method as in Example 1, except that the coating, sintering, pulverizing and classifying processes were repeated 3 times in the first sintering process. Mean particle size, amount of coating resin (Rc), heat decomposition peak temperature and electric resistance of the carrier obtained were 46 μm, 2.80%, 294° C., and about $2\times10^{10}\Omega$ cm, respectively.

COMPARATIVE EXAMPLE 5

A resin-coated carrier was obtained by the same method as in Comparative Example 1, except that sintered copper-zinc ferrite powder (F-300; mean particle size: 35 μm, bulk density: 2.50 g/cm$^3$; made by Powdertech Co., Ltd.) was used as a core material. Mean particle size, amount of coating resin (Rc), heat decomposition peak temperature and electric resistance of the carrier obtained were 39 μm, 2.48%, 222° C., and $8\times10^{9}\Omega$ cm, respectively.

COMPARATIVE EXAMPLE 6

A resin-coated carrier was obtained by the same method as in Comparative Example 1, except that sintered copper-zinc ferrite powder (F-300; mean particle size: 45 μm, bulk density: 2.70 g/cm$^3$; made by Powdertech Co., Ltd.) was used as a core material. Mean particle size, amount of coating resin (Rc), heat decomposition peak temperature and electric resistance of the carrier obtained were 49 μm, 2.65%, 221° C., and about $6\times10^{10}\Omega$ cm, respectively.

COMPARATIVE EXAMPLE 7

Sintered copper-zinc ferrite powder (F-300; mean particle size: 45 μm, bulk density: 2.40 g/cm$^3$; made by Powdertech Co., Ltd.) was used as a core material, and a resin-coated carrier was obtained by the same method as in Comparative Example 1, except that the coating, sintering, pulverizing and classifying processes were repeated 5 times. Mean particle size, amount of coating resin (Rc), heat decomposition peak temperature and electric resistance of the carrier obtained were 52 μm, 3.68%, 294° C., and about $2\times10^{10}\Omega$ cm, respectively. The number of aggregates in this carrier was so large that the carrier could not be pulverized into particles of primary particle size. Therefore, the evaluation of the carrier was impossible.

COMPARATIVE EXAMPLE 8

A resin-coated carrier was obtained by the same method as in Comparative Example 1, except that sintered copper-zinc ferrite powder (F-300; mean particle size: 45 μm, bulk density: 2.70 g/cm$^3$; made by Powdertech Co., Ltd.) was used as a core material, and the coating, sintering, pulverizing and classifying processes were repeated 3 times. Mean particle size and amount of coating resin (Rc) were 50 μm, and 3.49%, respectively. The number of aggregates in this carrier was so large that the carrier could not be pulverized into particles of primary particle size. Therefore, the evaluation of the carrier was impossible.

COMPARATIVE EXAMPLE 9

A resin-coated carrier was obtained by the same method as in Comparative Example 1, except that sintered copper-zinc ferrite powder (F-300; mean particle size: 38 μm, bulk density: 2.50 g/cm$^3$; made by Powdertech Co., Ltd.) was used as a core material. Mean particle size, amount of coating resin (Rc), heat decomposition peak temperature and electric resistance of the carrier obtained were 42 μm, 2.42%, 220° C., and about $9\times10^{9}\Omega$ cm, respectively.

COMPARATIVE EXAMPLE 10

A resin-coated carrier was obtained by the same method as in Comparative Example 1, except that sintered copper-zinc ferrite powder (F-300; mean particle size: 62 μm, bulk density: 2.50 g/cm$^3$; made by Powdertech Co., Ltd.) was used as a core material. Mean particle size, amount of coating resin (Rc), heat decomposition peak temperature and electric resistance of the carrier obtained were 64 μm, 2.58%, 224° C., and about $1\times10^{10}\Omega$ cm, respectively.

EVALUATION OF CARRIER

Eight parts by weight of the toner obtained above and 92 parts by weight of each carrier obtained in the above Examples and Comparative Examples were mixed to prepare a developer.

The developer was set in a copying machine EP570 (made by Minolta Camera K. K.) reformed for oil coating development. The copying process was repeated 5000 times to evaluate durability with respect to copy.

Fogs on copied images

Copied images were formed in the combinations of the above-described various types of toners and carriers by using the above-described copying machine. With respect to fogs in copied images, toner fogs on the white copy ground were evaluated and ranked. The ranks better than those marked by Δ means that the carrier can be put into practical use. Those better than the mark ○ are desirable.

Amount of spent toner

The amount of spent toner was measured by sampling the developer, separating the developer into toner and carrier by a blowing-off method, immersing about 1.00 g of separated carrier in 20 ml of ethanol for 2 hours and filtering the solution, and measuring the absorbance of the filtrate at 500 nm by using a spectrophotometer. A calibration curve is obtained in the separate measurement and the amount of the eluted dye in the toner is calculated from the absorbance at 500 nm described above. The amount of the spent toner (mg/lg of carrier) defined as the amount of the toner adhering to the carrier is determined from the above value and the proportion of the dye included in the toner.

Heat resistance

Ten gram of carrier was placed in a vessel and was allowed to stand in an oven at 60° C. for 1 hour and cooled. It was observed whether carrier aggregated or not. The results was ranked as follows:

○: No aggregation is observed.

Δ: Aggregation is observed but aggregates are easily crushed (lower limit of practical use).

x: many and big aggregates are observed and the aggregates cannot be crushed (impossible for practical use).

Amount of charge

Measured by a blowing-off method (Concentration of toner: 8% by weight)

State of carrier surface

The surface of the carrier was observed by using an electron microscope (×2000) by separating the developer from the carrier by a blowing-off method before and after development.

Quality of copied images

In various combinations of toners and carriers as described above, copied images having gradation from white to solids were formed by using the above copying machine. The uniformity of adhesion property of the toner were evaluated visually. The results were ranked.

○:Quite uniform and excellent

Δ: Color deficiency and non-uniformity are observed in detailed observation but it can be put into practical use.

x: Color deficiency is remarkable and it is not adequate for practical use.

Sintered copper-zinc ferrite powder (F-300; mean particle size: 50 μm, bulk density: 2.53 g/cm$^3$; made by Powdertech Co., Ltd.) was used as a core material, and the powder was coated with the solution of styrene-acrylic resin described above by using SPIRA COTA (made by Okada Seiko K. K.), followed by drying. The carrier obtained sintered in a hot-air circulating oven for 2 hours at 140° C. After cooling, the ferrite powder bulk was pulverized and classified by the same method as in Example 1 to obtain a ferrite powder coated with the resin. The coating, sintering, pulverizing and classifying processes described above were repeated 3 times more to the resulting ferrite powder (first sintering).

The ferrite powder obtained in the first sintering process was sintered again in the above-described oven at 170° C. for 3 hours (second sintering). After cooled, the ferrite powder was pulverized and classified as described above to obtain a resin-coated carrier.

Mean particle size, amount of coating resin (Rc), heat decomposition peak temperature, electric resistance and ratio of integrated intensity of the carrier obtained were 52 μm, 2.95%, 295° C., about $4\times10^{10}\Omega$ cm and 0.08, respectively.

EXAMPLE 6

A resin solution (thermoset-starting temperature: 120° C.) containing 80 parts by weight of acrylic resin (Acrydic A-405; made by Dainippon Ink Kagaku Kogyo K. K.) and 20 parts by weight of butylated melamine resin was used and a ferrite powder was coated with the solution by using SPIRA COTA as in Example 1. After dried, the ferrite powder bulk was pulverized and classified as in Example 1 to obtain ferrite particles

TABLE 1

| Sample | Amount of charge (μc/g) Initial | Amount of charge (μc/g) After 5000 times of copy | Carrier fogs Initial | Carrier fogs After 5000 times of copy | Toner fogs Initial | Toner fogs After 5000 times of copy | State of carrier surface Initial | State of carrier surface After 5000 times of copy | Carrier resistance (before mixed with toner) | Quality of copied image |
|---|---|---|---|---|---|---|---|---|---|---|
| Example 1 | −15.6 | −14.0 | ○ | ○ | ○ | ○ | Normal | Normal | $5\times10^{10}$ | ○ |
| Example 2 | −15.5 | −13.6 | ○ | ○ | ○ | ○~Δ | ↑ | ↑ | $4\times10^{10}$ | ○~Δ |
| Comparative Example 1 | −11.9 | −8.0 | ○ | ○ | Δ | x | ↑ | ↑ | $9\times10^{9}$ | ○ |
| Comparative Example 2 | −13.5 | −10.2 | x | Δ~x | ○~Δ | x | ↑ | ↑ | $1\times10^{10}$ | ○ |
| Comparative Example 3 | −18.0 | −13.4 | ○ | Δ | ○ | Δ~x | ↑ | Peeling | $7\times10^{10}$ | ○~Δ |
| Comparative Example 4 | −12.8 | −11.2 | ○ | ○ | ○ | ○ | ↑ | Normal | $4\times10^{10}$ | x |
| Example 3 | −15.5 | −14.4 | ○ | ○ | ○ | ○ | ↑ | Normal | $8\times10^{10}$ | ○ |
| Example 4 | −15.1 | −13.0 | ○ | ○ | ○ | ○~Δ | ↑ | ↑ | $2\times10^{10}$ | ○ |
| Comparative Example 5 | −17.3 | −10.2 | ○ | Δ~x | x | x | ↑ | ↑ | $8\times10^{9}$ | ○ |
| Comparative Example 6 | −16.1 | −9.5 | ○ | Δ | Δ | x | ↑ | Peeling | $6\times10^{10}$ | ○ |
| Comparative Example 7 | — | — | — | — | — | — | — | — | — | — |
| Comparative Example 8 | — | — | — | — | — | — | — | — | — | — |
| Comparative Example 9 | −16.1 | −11.3 | x | Δ~x | Δ | x | Normal | Normal | $9\times10^{9}$ | ○ |
| Comparative Example 10 | −17.2 | −10.5 | ○ | ○ | ○ | ○ | ↑ | ↑ | $1\times10^{10}$ | Δ~x |

EXAMPLE 5

A solution of styrene-acrylic resin with a solid fraction of 2% was prepared by the same method as in Example 1. Thermoset-starting temperature of this resin was about 130° C. after the solution of styrene-acrylic resin was dried.

coated with the acrylic resin. The coating, sintering, pulverizing and classifying processes above described were repeated twice more to complete the first sintering.

The ferrite powder obtained in the first sintering process was sintered again for 1 hour at 170° C. (second sintering) as in Example 1 to obtain a resin-coated carrier.

Mean particle size, amount of coating resin (Rc), heat decomposition peak temperature, electric resistance and ratio of integrated intensity of the carrier obtained were 53 μm, 3.01%, 288° C., about $2\times10^{10}\Omega$ cm and 0.15, respectively.

COMPARATIVE EXAMPLE 11

A resin-coated carrier was obtained by the same method as in Example 5, except that the second sintering process in Example 5 was not carried out.

Mean particle size, amount of coating resin (Rc), heat decomposition peak temperature, electric resistance and ratio of integrated intensity of the carrier obtained were 55 μm, 3.30%, 232° C., about $9\times10\Omega$ cm and 1.15, respectively.

COMPARATIVE EXAMPLE 12

A resin-coated carrier was obtained by the same method as in Example 6, except that the second sintering process in Example 6 was not carried out.

Mean particle size, amount of coating resin (Rc), heat decomposition peak temperature, electric resistance and ratio of integrated intensity of the carrier obtained were 55 μm, 3.11%, 241° C., about $6\times10^{10}\Omega$ cm and 0.63, respectively.

COMPARATIVE EXAMPLE 13

The same core material and resin solution as in Example 5 were used and the core material was coated with the solution by using SPIRA COTA as in Example 5, and sintered at 190° C. for 2 hours after dried. The sintered powder was pulverized and classified as in Example 5. The coating, sintering, pulverizing and classifying processes were repeated twice more to obtain a resin-coated carrier.

Mean particle size, amount of coating resin (Rc), heat decomposition peak temperature, electric resistance and ratio of integrated intensity of the carrier obtained were 51 μm, 2.90%, 269° C., $4\times10^{10}\Omega$ cm and 0.02, respectively.

EXAMPLE 7

A resin-coated carrier was obtained by the same method as in Example 5, except that the first sintering temperature was 130° C. and the second sintering temperature was 140° C. Mean particle size, amount of coating resin (Rc), heat decomposition peak temperature, electric resistance and ratio of integrated intensity of the carrier obtained were 54 μm, 3.16%, 277° C., about $7\times10^{10}\Omega$ cm and 0.46, respectively.

EXAMPLE 8

A resin-coated carrier was obtained by the same method as in Example 5, except that the first sintering temperature was 130° C. and the second sintering temperature was 175° C. Mean particle size, amount of coating resin (Rc), heat decomposition peak temperature, electric resistance and ratio of integrated intensity of the carrier obtained were 53 μm, 3.02%, 287° C., about $4\times10^{10}\Omega$ cm and 0.09, respectively.

EXAMPLE 9

A resin-coated carrier was obtained by the same method as in Example 5, except that the first sintering temperature was 150° C. and the second sintering temperature was 200° C. Mean particle size, amount of coating resin (Rc), heat decomposition peak temperature, electric resistance and ratio of integrated intensity of the carrier obtained were 51 μm, 2.78%, 303° C., about $1\times10^{10}\Omega$ cm and 0.06, respectively.

COMPARATIVE EXAMPLE 14

A resin-coated carrier was obtained by the same method as in Example 5, except that the first sintering temperature was 170° C. and the second sintering temperature was 160° C. Mean particle size, amount of coating resin (Rc), heat decomposition peak temperature, electric resistance and ratio of integrated intensity of the carrier obtained were 53 μm, 2.99%, 270° C., about $5\times10^{10}\Omega$ cm and 0.53, respectively.

COMPARATIVE EXAMPLE 15

A resin-coated carrier was obtained by the same method as in Example 5, except that the first sintering temperature was 120° C. and the second sintering temperature was 130° C. Mean particle size, amount of coating resin (Rc), heat decomposition peak temperature, electric resistance and ratio of integrated intensity of the carrier obtained were 56 μm, 3.02%, 235° C., about $2\times10^{10}\Omega$ cm and 0.59, respectively.

COMPARATIVE EXAMPLE 16

A resin-coated carrier was obtained by the same method as in Example 5, except that the first sintering temperature was 170° C. while the second sintering temperature was 220° C. Mean particle size, amount of coating resin (Rc), heat decomposition peak temperature, electric resistance and ratio of integrated intensity of the carrier obtained were 50 μm, 2.65%, 310° C., about $7\times10^{9}\Omega$ cm and 0.02, respectively.

Evaluation of Carrier

Evaluation of carrier was carried out as in Example 1. The results are listed in Table 2.

TABLE 2

| | Amount of charge (μc/g) | | Toner fogs | | | |
|---|---|---|---|---|---|---|
| | Initial | After 5000 times of copy | Initial | After 5000 times of copy | Amount of spent toner (mg/g) | Heat resistance |
| Example 5 | −15.1 | −13.9 | ○ | ○ | 22 | ○ |
| Example 6 | −15.6 | −13.5 | ○ | ○ | 28 | ○~Δ |
| Comparative Example 11 | −14.9 | −10.0 | ○ | Δ | 65 | Δ |
| Comparative Example 12 | −14.4 | −11.1 | ○ | Δ | 83 | x |
| Comparative Example 13 | −15.8 | −10.5 (Peeling) | ○ | Δ | 53 | ○ |
| Example 7 | −15.0 | −12.8 | ○ | ○ | 22 | ○~Δ |
| Example 8 | −16.2 | −14.4 | ○ | ○ | 20 | ○ |
| Example 9 | −16.8 | −14.8 | ○ | ○ | 20 | ○ |
| Comparative Example 14 | −15.2 | −9.5 | ○ | Δ | 51 | ○~Δ |
| Comparative Example 15 | −14.2 | −9.6 | ○ | Δ~x | 94 | x |
| Comparative Example 16 | −17.5 | −9.8 (Peeling) | ○ | Δ~x | 97 | ○ |

EXAMPLE 10

A solution of styrene-acrylic resin with a solid fraction of 2% was prepared by the same method as in Example 1.

Sintered ferrite powder (F-300; mean particle size: 50 μm, bulk density: 2.53 g/cm$^3$; made by Powdertech Co., Ltd.) was used as a core material, and the powder was coated with the solution of styrene-acrylic resin described above by using SPIRA COTA (made by Okada Seiko K. K.), followed by drying. The obtained carrier was sintered in a hot-air circulating oven for 2 hours at 140° C. After cooled, the obtained ferrite bulk was crushed in the same method as in Example 1 to obtain a resin-coated ferrite powder. The coating, sintering, pulverizing and classifying processes described above were repeated 2 times more to the resulting ferrite powder (first sintering).

Coating conditions were adjusted so that the amount of the first coating was 1.4% by weight on the basis of the ferrite powder, 1.0% by weight in the second coating and 0.6% by weight in the third coating.

The ferrite powder obtained in the first sintering process was sintered again in the above-described oven at 170° C. for 3 hours (second sintering). After cooled, the ferrite powder was pulverized and classified as described above to obtain a resin-coated carrier.

Mean particle size, amount of coating resin (Rc), bulk density and electric resistance of the carrier obtained were 52 μm, 2.95%, 2.43 g/cm$^3$ and about $8\times10^{10}\Omega$ cm, respectively.

The amount of adsorption was determined by using an adsorption measuring apparatus BELSORP 36 (made by Nihon Bell K. K.). When the numbers of adsorbed $CO_2$ molecules n (molecules/nm$^2$) per unit area before and after the coating were measured from $CO_2$, $N_2$ gas isothermal adsorption curves by the BET method, the values of $n_1$ (before coating)=8.5, $n_2$ (after coating)=230 were obtained, hence $n_2/n_1=27$.

EXAMPLE 11

A resin solution containing 80 parts by weight of acrylic resin (Acrydic A-405; made by Dainippon Ink Kagaku Kogyo K. K.) and 20 parts by weight of butylated melamine resin was used, and a ferrite powder (F-300; mean particle size: 48 μm, bulk density: 2.49 g/cm$^3$; made by Powdertech Co., Ltd.) was coated with the solution. After dried, the coated powder sintered at 150° C. for 2 hours. After cooled, the ferrite powder bulk was pulverized and classified as in Example 1 to obtain an acrylic resin-coated ferrite powder. The above described coating, sintering, pulverizing and classifying processes were repeated 3 times more to finish first sintering.

Coating conditions were set so that the amount of the first coating was 1.1% by weight on the basis of the ferrite powder, 1.1 % by weight in the second coating and 0.9% by weight in the third coating.

The ferrite powder obtained in the first sintering process was sintered again as in Example 11 at 170° C. for 4 hours (second sintering) to obtain a resin-coated carrier.

Mean particle size, amount of coating resin (Rc), bulk density and electric resistance of carrier obtained were 54 μm, 3.33%, 2.40 g/cm$^3$ and about $7\times10^{10}\Omega$ cm, respectively.

When the number of adsorbed $CO_2$ molecules n was determined as in Example 10, the values of $n_1$ (before coating)=12.3, $n_2$ (after coating)=420 were obtained, hence $n_2/n_1=34$.

COMPARATIVE EXAMPLE 17

A coated carrier was prepared by the same method as in Example 10, except that the coating ratio in the first, second and the third coating processes in Example 10 were adjusted to 1% by weight, respectively, and that the second sintering process was carried out at 140° C. for 3 hours.

Mean particle size, amount of coating resin (Rc), bulk density and electric resistance of the carrier obtained were 53 μm, 2.98%, 2.45 g/cm$^3$ and $4\times10^{10}\Omega$ cm, respectively.

The numbers of adsorbed $CO_2$ molecules were $n_1=8.5$, $n_2=153$, hence $n_2/n_1=18.0$.

COMPARATIVE EXAMPLE 18

A coated carrier was prepared by the same method as in Example 11, except that the coating ratio in the first, second, third, and fourth coating processes in Example 11 were adjusted to 0.9% by weight, 0.8% by weight, 0.8% by weight, and 0.9% by weight, respectively, and that the second sintering process was carried out at 140° C. for 4 hours.

Mean particle size, amount of coating resin (Rc), bulk density and electric resistance of the carrier obtained were 57 μm, 3.30%, 2.39 g/cm$^3$ and $3\times10^{10}\Omega$ cm, respectively.

The numbers of adsorbed $CO_2$ molecules were $n_1=12.3$, $n_2$32 166, hence $n_2/n_1=13.5$.

Evaluation

A developer was prepared by mixing 8 parts by weight of the toner prepared above and 92 parts by weight of each carrier prepared in the above Examples 10 and 11, and Comparative Examples 17 and 18.

The developers were set in a copying machine EP-570 (made by Minolta Camera K. K.) modified for oil coating development. The copying process was repeated 5000 times for the evaluation on the following items.

Amount of charge

A blowing-off method was used (toner concentration: 8% by weight)

Toner fogs

Evaluated as described in Example 1.

Adhesion of carrier

Adhesion degrees of the carrier on white-copy ground were evaluated to be ranked as done in the toner fogs. The carrier having a rank better than that marked by Δ is practically usable, but the ones having a rank better than the rank ○ are preferable.

Environmental change of charging

The amount of charge were measured the toner was kept for 24 hours in the environment of 10° C. in temperature and 15% in relative humidity, and after the toner was kept for 24 hours in the environment of 30° C. and 85% were measured.

Scattering conditions in the copying machine

The scattering degree of the toner in the copying machine was also evaluated at the initial stage and after 5000 times of copy using the copying machine described above. The results were ranked. The developers having a rank better than that marked by Δ are practically usable, but the ones having the mark better than ○ are preferable.

The results are listed in Table 3.

TABLE 3

| | Amount of charge (μc/g) | | Toner fogs | | | Amount of charge (μc/g) | | Scattering state in the machine | |
|---|---|---|---|---|---|---|---|---|---|
| | Initial | After 5000 times of copy | Initial | After 5000 times of copy | Carrier adhesion | 10° C. 15% RH | 30° C. 85% RH | Initial | After 5000 times of copy |
| Example 10 | −15.5 | −13.8 | ○ | ○ | ○ | −18.2 | −13.1 | ○ | ○~Δ |
| Example 11 | −16.2 | −15.1 | ○ | ○ | ○ | −18.5 | −13.9 | ○ | ○ |
| Comparative Example 17 | −12.8 | −9.3 | ○ | Δ~x | Δ | −16.4 | −9.8 | ○ | x |
| Comparative Example 18 | −14.7 | −10.5 | ○~Δ | x | x | −17.1 | −10.6 | Δ | x |

EXAMPLE 12

Sintered copper-zinc ferrite powder (F-300; mean particle size: 50 μm, bulk density: 2.54 g/cm$^3$; the ratio of small particles having a particle size of 31 μm or less: 3.1 volume %; made by Powdertech Co., Ltd.) was used as a core material, and the powder was coated with the solution of styrene-acrylic resin obtained in Example 1 by using SPIRA COTA (made by Okada Seiko K. K.), followed by drying. The carrier obtained was sintered in a hot-air circulating oven for 2 hours at 140° C. After cooled, the ferrite powder bulk was pulverized and classified to form a resin-coated ferrite powder by the same method in Example 1. The coating, sintering, pulverizing and classifying processes described above were repeated 3 times more to the resulting ferrite powder (first sintering).

The ferrite powder obtained in the first sintering process was sintered again in the above-described oven at 170° C. for 3 hours (second sintering). After cooled, the ferrite bulk was pulverized and classified as described above to obtain a resin-coated carrier. Mean particle size, amount of coating resin (Rc), bulk density, particle size distribution below 31 μm and ratio of change of the particles of more than 62 μm were 53 μm, 3.30 volume %, 2.46 g/cm$^3$, 2.0% by weight and 25%, respectively.

Heat decomposition peak temperature and electric resistance were 291° C. and about $5\times10^{10}\Omega$ cm, respectively.

EXAMPLE 13

Sintered copper-zinc ferrite powder (F-300; mean particle size: 50 μm, bulk density: 2.54 g/cm$^3$; ratio of small particles having a particle size of 31 μm or less: 2.8 volume %; made by Powdertech Co., Ltd.) was used as a core material, and the powder was coated with the solution of styrene-acrylic resin obtained in Example 1 by using SPIRA COTA (made by Okada Seiko K. K.), followed by drying. The carrier obtained was sintered in a hot-air circulating oven for 2 hours at 140° C. After cooled, the ferrite powder bulk was pulverized and classified to form a resin-coated ferrite powder by the same method described in Example 1. The coating, sintering, pulverizing and classifying processes described above were repeated 3 times more to the resulting ferrite powder (first sintering).

The ferrite powder obtained in the first sintering process was sintered again in the above-described oven at 170° C. for 3 hours (second sintering). After cooled, the ferrite bulk was pulverized and classified as described above to obtain a resin-coated carrier. Mean particle size, amount of coating resin (Rc), bulk density, particle size distribution below 31 μm and ratio of change of the particles of more than 62 μm were 55 μm, 3.15 volume %, 2.44 g/cm$^3$, 1.5% by weight and 74%, respectively.

COMPARATIVE EXAMPLE 19

Sintered copper-zinc ferrite powder (F-300; mean particle size: 50 μm, bulk density: 2.54 g/cm$^3$; ratio of small particles having a particle size of 31 μm or less: 21.8 volume %; made by Powdertech Co., Ltd.) was used as a core material, and the powder was coated with the same solution of styrene-acrylic resin as in Example 12 by using SPIRA COTA (made by Okada Seiko K. K.), followed by drying. The carrier obtained was sintered in a hot-air circulating oven for 2 hours at 140° C. After cooled, the ferrite powder bulk was pulverized and classified to form a resin-coated ferrite powder by the same method as in Example 1. The coating, sintering, pulverizing and classifying processes described above were repeated once more to the resulting ferrite powder to obtain a resin-coated carrier.

Mean particle size, amount of coating resin (Rc), bulk density, particle size distribution below 31 μm and ratio of change of the particles of more than 62 μm of the carrier obtained were 54 μm, 3.28 volume %, 2.45 g/cm$^3$, 2.0%, and 120%, respectively.

COMPARATIVE EXAMPLE 20

A resin-coated carrier was obtained by the same method as in Comparative Example 19, except that the sintering process was carried out at 170° C. for 2 hours. Mean particle size, amount of coating resin (Rc), bulk density, particle size distribution below 31 μm and ratio of change of the particles of more than 62 μm were 53 μm, 3.14 volume %, 2.46 g/cm$^3$, 2.0%, and 108%, respectively.

Evaluation of the Carrier

A developer was prepared by mixing 8 parts by weight of the toner prepared above and 92 parts by weight of each carrier prepared in the above Examples 12 and 13 and Comparative Examples 19 and 20.

With these developers, copying process was repeated 1000 times to evaluate durability with respect to copy by using a copying machine EP-570 (made by Minolta Camera K. K.) modified for oil coating development. The following items were evaluated.

Amount of charge

A blowing-off method was used (toner concentration: 8% by weight)

Adhesion of carrier

Evaluated as in Example 10.

Toner fogs

Evaluated as in Example 1.

Voids

Copied images were formed in combinations of the carriers and the toner by using the copying machine. With respect to voids on copied images, the degree of carrier adhesion in solid images was evaluated and ranked. A developer having the rank better than the rank marked by Δ is practically usable, but the one having the mark better than the mark ◯ is desirable.

The results are listed in Table 4.

TABLE 4

| | Amount of charge (μc/g) | | Carrier adhesion | | Toner fogs | | Void | |
|---|---|---|---|---|---|---|---|---|
| | Initial | After 1000 times of copy | Initial | After 1000 times of copy | Initial | After 1000 times of copy | Initial | After 1000 times of copy |
| Example 12 | 19.4 | 17.8 | ∘ | ∘ | ∘ | ∘ | Δ | Δ |
| Example 13 | 17.2 | 16.3 | ∘ | ∘ | ∘ | ∘~Δ | Δ | Δ |
| Comparative Example 19 | 17.3 | 16.4 | x | Δ~x | ∘ | ∘~Δ | Δ~x | x |
| Comparative Example 20 | 17.4 | 16.6 | Δ~x | Δ | ∘ | ∘~Δ | Δ~x | Δ~x |

EXAMPLE 14

A carrier core material having a mean particle size of 52 μm and a surface area index of 3.3 (specific surface area by BET method: 1140 $cm^2/g$, specific surface area by air permeation method: 345 $cm^2/g$) was obtained from ferrite particles (F-300, made by Powdertech Co., Ltd.). The carrier core material was coated with a toluene solution of 78% by weight of acrylic-styrene resin (styrene - methyl methacrylate - ethyl acrylate -2-hydroxyethyl methacrylate -polyether polyol [composition ratio: 10:57:12:6:15]) and 22% by weight of melamine resin (hexamethoxymethylol melamine) in an amount of 3.0% by weight by using a fluid bed. The material was baked at 160° C. for 5 hours to obtain a carrier. The integrated intensity ratio (Im/Is) of the carrier and the amount of coating resin (Rc) were 0.20 and 2.9%, respectively.

The following color toners were used for the evaluation of carrier.

| Yellow toner | Parts by weight |
|---|---|
| Styrene-acrylic modified polyester resin | 100 |
| Organic pigment Lionol Yellow FG-1310 (made by Toyo Ink Seizo K.K.) | 2.5 |
| Charge controlling agent Bontron E-84 (made by Orient Kagaku K.K.) | 3 |

The above materials were mixed thoroughly in Henschel mixer, kneaded in a two-axis extruder and cooled. The mixture was roughly pulverized in a feather mill. The obtained particles were pulverized in a jet grinder and classified by an air classifier to obtain yellow particles having a particle size of 5 to 25 μm (mean particle size: 10.5 μm). One percent by weight of hydrophobic titanium (T-805; made by Nihon Aerosil K. K.) and 0.2% by weight of hydrophobic silica (H2000/4; made by Wacker K. K.) were added to the yellow particles and mixed in Henschel mixer to obtain a yellow toner.

Magenta Toner

A Magenta toner prepared by the same method as in the yellow toner was used, except that 2.5 parts by weight of Lionol Red 6B FG-4213 (made by Toyo Ink Seizo K. K.) was used as a pigment.

Cyan Toner

A Cyan toner prepared manufactured by the same method as in the yellow toner was used, except that 2.5 parts by weight of Lionol Blue FG-7350 (made by Toyo Ink Seizo K. K.) was used as a pigment.

Black Toner

A Black toner prepared by the same method as in the yellow toner was used, except that 2.5 parts by weight of carbon black MA#8 (made by Mitsubishi Kasei K. K.) was used as a pigment.

The carrier obtained in Example 14 was mixed with each color toner at the content of 7% by weight of toner. The obtained developers were evaluated on durability with respect to copy by using a copying machine CF70 (made by Minolta Camera K. K.). The evaluations of copied images (copied image density, fogs on copied images, adhesion of carrier, scattering of toner, environmental change of charge amount and overall evaluation) were ranked as follows:

◎: Very good, ◯: Good, Δ: Rather poor, x: Poor

The results are shown in Table 5 and Table 6.

EXAMPLE 15

A carrier core material having a mean particle size of 48 μm, a surface area index of 2.8 (specific surface area by BET method: 1002 $cm^2/g$, specific surface area by air permeation method: 358 $cm^2/g$) was obtained from ferrite particles (F-300; made by Powdertech Co., Ltd.). The carrier core material was coated with a methanol solution of 75% by weight of acrylic-styrene resin (styrene - methyl methacrylate - ethyl acrylate -2-ethylhexyl acrylate - methacrylic acid - 2-hydroxyethyl methacrylate - methacrylic acid polypropyleneglycol monoester [composition ratio: 12.4:27.6:29:10:6: 8:7]) and 25% by weight of melamine resin (hexamethoxymethylol melamine) in an amount of 3.5% by weight by using a fluid bed. The material was baked at 165° C. for 6 hours to obtain a carrier. The integrated intensity ratio (Im/Is) of the carrier and the amount of coating resin (Rc) were 0.18 and 3.2%, respectively.

The resultant carrier was evaluated in a manner similar to Example 14. The results were shown in Table 5 and 6.

EXAMPLE 16

A carrier core material having a mean particle size of 58 μm and a surface area index of 4.5 (specific surface area by BET method: 1463 $cm^2/g$, specific surface area by air permeation method: 325 $cm^2/g$) was obtained from ferrite particles (F-2535; made by Powdertech Co., Ltd.). The carrier core material was coated with 83% by weight of acrylic-styrene resin (styrene - methyl methacrylate - ethyl acrylate - 2-ethylhexyl methacrylate - polyether polyol [composition ratio: 7.3:67.7:12:6:7]) and 17% by weight of melamine resin (hexamethoxymethylol melamine) in an amount of 2.8% by weight by using the same method as in Example 15. The material was baked at 170° C. for 4 hours to obtain a carrier coated with the resin described above. The integrated intensity ratio (Im/Is) of the carrier and the amount of coating resin (Rc) were 0.13 and 2.7%, respectively.

The resultant carrier was evaluated in a manner similar to Example 14. The results were shown in Table 5 and 6.

EXAMPLE 17

The same carrier core material and resin as in Example 14 were used and the core material was coated with the resin dissolved in toluene by using a fluid bed. The coated carrier core was baked at 140° C. for 2 hours. After cooled, the ferrite powder bulk was pulverized and classified. The coating, baking, pulverizing and classifying processes were repeated 3 times more. The ferrite powder obtained sintered at 170° C. for 3 hours. After cooled, a carrier was pulverized and classified as described above. The integrated intensity ratio of the carrier and the amount of coating resin were 0.08 and 2.94%, respectively.

The resultant carrier was evaluated in a manner similar to Example 14. The results were shown in Table 5 and 6.

COMPARATIVE EXAMPLE 21

A carrier core material having a mean particle size of 60 μm and a surface area index of 2.3 (specific surface area by BET method: 720 $cm^2/g$ and specific surface area by air permeation method: 313 $cm^2/g$) obtained from ferrite particles (F-2535; made by Powdertech Co., Ltd.) was coated with 63% by weight of acrylic-styrene resin (styrene - methyl methacrylate - ethyl methacrylate - 2-hydroxyethyl methacrylate - polyether polyol [composition ratio: 17.3:22.7:7:33:20]) and 37% by weight of melamine resin (hexamethoxymethylol melamine) in an amount of 3.0% by weight by the same method as in Example 14. The material was baked at 130° C. for 1 hour to obtain a carrier. The integrated intensity ratio (Im/Is) of the carrier and the amount of coating resin were 0.58 and 2.9%, respectively.

The resultant carrier was evaluated in a manner similar to Example 14. The results were shown in Table 5 and 6.

COMPARATIVE EXAMPLE 22

A carrier core material in Comparative Example 22 was coated with a resin composed of 60% by weight of acrylic-styrene resin (styrene - methyl methacrylate - ethyl methacrylate - 2-hydroxyethyl methacrylate - polyether polyol [composition ratio: 11.8:69.2:16:2:1]) and 40% by weight of melamine resin (hexamethoxymethylol melamine) in an amount of 3.0% by weight by the same method as in Example 14. The material was baked at 135° C. for 2 hours to obtain a carrier. The integrated intensity ratio (Im/Is) of the carrier and the amount of coating resin were 1.10 and 2.9%, respectively.

The resultant carrier was evaluated in a manner similar to Example 14. The results were shown in Table 5 and 6.

COMPARATIVE EXAMPLE 23

A carrier core material having a mean particle size of 25 μm and a surface area index of 6.0 (specific surface area by BET method: 3540 $cm^2/g$ and specific surface area by air permeation method: 590 $cm^2/g$) was obtained from ferrite particles (F-500; made by Powdertech Co., Ltd.). The material was coated with the resin in Example 16 in an amount of 4.0% by weight by the same method as in Example 15. The material was baked at 120° C. for 2 hours to obtain a carrier. The integrated intensity ratio (Im/Is) of the carrier and the amount of coating resin were 0.61 and 3.8%, respectively.

The resultant carrier was evaluated in a manner similar to Example 14. The results were shown in Table 5 and 6.

COMPARATIVE EXAMPLE 24

A carrier core material having a mean particle size of 80 μm and a surface area index of 1.7 (specific surface area by BET method: 310 $cm^2/g$; specific surface area by air permeation method: 182 $cm^2/g$) was obtained from ferrite particles (F-150; made by Powdertech Co., Ltd.). The carrier core material was coated with the resin in Example 15 in an amount of 2.0% by weight by using the same method as in Example 16. The material was baked at 150° C. for 5 hours to obtain a carrier coated with the resin described above. The integrated intensity ratio (Im/Is) of the carrier and the amount of coating resin (Rc) were 0.03 and 1.9%, respectively.

The resultant carrier was evaluated in a manner similar to Example 14. The results were shown in Table 5 and 6.

COMPARATIVE EXAMPLE 25

A carrier core material having a mean particle size of 45 μm and a surface area index of 4.8 (specific surface area by BET method: 2016 $cm^2/g$, specific surface area by air permeation method: 420 $cm^2/g$) was obtained from ferrite particles (F-3040; made by Powdertech Co., Ltd.). The carrier core material was coated with a resin composed of 67% by weight of acrylic-styrene resin (styrene - methyl methacrylate - ethyl acrylate - 2-hydroxyethyl methacrylate - polyether polyol [composition ratio: 15.3:44.7:12:10:18]) and 33% by weight of melamine resin (hexamethoxymethylol melamine) in an amount of 4.3% by using the same method as in Example 14. The material was baked at 90° C. for 2 hours to obtain a carrier. The integrated intensity ratio (Im/Is) of the carrier and the amount of coating resin (Rc) were 0.63 and 4.1%, respectively.

The resultant carrier was evaluated in a manner similar to Example 14. The results were shown in Table 5 and 6.

COMPARATIVE EXAMPLE 26

A carrier was obtained by the same method as in Comparative Example 25, except that a baking process was carried out at 200° C. for 5 hours. The integrated intensity (Im/Is) of the carrier and the amount of the coating resin were 0.03 and 4.1%, respectively.

The resultant carrier was evaluated in a manner similar to Example 14. The results were shown in Table 5 and 6.

TABLE 5

| Example and Comparative Example No. | Core particle size (μm) | Core surface area index | Functional acrylic acid ester or methacrylic acid ester (wt %) | Melamine (wt %) | Coating amount (wt %) | Baking condition Temperature (°C.) | Baking condition Time (hr) | Integrated intensity |
|---|---|---|---|---|---|---|---|---|
| Example 14 | 52 | 3.3 | 16.4 | 22.0 | 3.0 | 160 | 5 | 0.20 |
| Example 15 | 48 | 2.8 | 15.8 | 25.0 | 3.5 | 165 | 6 | 0.18 |
| Example 16 | 58 | 4.5 | 10.8 | 17.0 | 2.8 | 170 | 4 | 0.13 |
| Comparative Example 21 | 60 | 2.3 | 33.4 | 37.0 | 3.0 | 130 | 1 | 0.58 |
| Comparative Example 22 | 60 | 2.3 | 1.8 | 40.0 | 3.0 | 135 | 2 | 1.10 |
| Comparative Example 23 | 25 | 6.0 | 15.8 | 25.0 | 4.0 | 120 | 2 | 0.61 |
| Comparative Example 24 | 80 | 1.7 | 15.8 | 25.0 | 2.0 | 150 | 5 | 0.03 |
| Comparative Example 25 | 45 | 4.8 | 19.0 | 33.0 | 4.3 | 90 | 2 | 0.63 |
| Comparative Example 26 | 45 | 4.8 | 19.0 | 33.0 | 4.3 | 200 | 5 | 0.03 |

TABLE 6

| Example and Comparative Example No. | Image concentration Initial | Image concentration After 5000 times of copy | Fogs on copied images Initial | Fogs on copied images After 5000 times of copy | Carrier adhesion Initial | Carrier adhesion After 5000 times of copy | Toner scattering Initial | Toner scattering After 5000 times of copy | Environmental change of charging | Overall evaluation |
|---|---|---|---|---|---|---|---|---|---|---|
| Example 14 | ◎ | ◎ | ◎ | ○ | ◎ | ◎ | ◎ | ◎ | ◎ | ◎ |
| Example 15 | ◎ | ◎ | ◎ | ○ | ◎ | ◎ | ◎ | ◎ | ◎ | ◎ |
| Example 16 | ◎ | ◎ | ◎ | ○ | ◎ | ◎ | ◎ | ◎ | ◎ | ◎ |
| Example 17 | ◎ | ◎ | ◎ | ○ | ◎ | ◎ | ◎ | ◎ | ◎ | ◎ |
| Comparative Example 21 | x | x | ○ | Δ | Δ | Δ | ○ | Δ | Δ | Δx |
| Comparative Example 22 | ○ | Δ | x | x | Δ | Δ | x | x | x | x |
| Comparative Example 23 | ○ | x | Δ | x | x | x | ○ | x | Δ | x |
| Comparative Example 24 | x | x | x | x | Δ | Δ | x | x | x | x |
| Comparative Example 25 | ○ | x | x | x | ○ | ○ | x | x | x | x |
| Comparative Example 26 | Δ | Δ | ○ | ○ | Δ | Δ | ○ | ○ | x | Δx |

◎: Very good; ○: Good; Δ: Rather poor; x: Poor Table 6

What is claimed is:

1. A carrier for developing electrostatic latent images comprising;

carrier core particles having a mean particle size of 40 to 60 μm and a bulk density of 2.45 to 2.65 g/cm$^3$, and resin-coating layers the amount of which is 2.7 to 3.5% by weight on the basis of the carrier core particles.

2. A carrier for developing electrostatic latent images as claimed in claim 1, wherein heat decomposition peak temperature of the coating resin is 275° C. or more.

3. A carrier for developing electrostatic latent images as claimed in claim 1, having a bulk density of 2.35 to 2.55 g/cm$^3$ after coated with the coating resin.

4. A carrier for developing electrostatic latent images comprising;

carrier core particles composed of a magnetic material; and a resin-coating layer formed by a production method comprising a step of coating the carrier core particles with a solution of thermosetting resin;

a step of sintering first the coated particles at a temperature between a thermoset-starting temperature and the thermoset-starting temperature plus 30 ° C.,; and a step of sintering second the first sintered particles at a temperature between the first sintering temperature and the first sintering temperature plus 50° C.

5. A carrier for developing electrostatic latent images as claimed in claim 4, wherein the production method further comprises a pulverizing step between the first sintering step and the second sintering step.

6. A carrier for developing electrostatic latent images as claimed in claim 4, wherein the thermosetting resin is formed by cross-linking an acrylic polymer or a styrene-acrylic copolymer with a melamine compound.

7. A carrier for developing electrostatic latent images composed of carrier core particles and a thermosetting resin-coating layer, wherein the number of adsorbed molecules n (molecules/nm$^2$) of carbon dioxide ($CO_2$) per unit area of the carrier expressed by the following formula (I):

$$n = \frac{(CO_2)(\text{ml/g}) \times (A)(\text{molecules/mole})}{(22414)(\text{ml/mole}) \times (N_2)(\text{cm}^2/\text{g}) \times (10^{18})(\text{nm}^2/\text{cm}^2)} \quad \text{(I)}$$

wherein ($CO_2$) represents an adsorbed amount of $CO_2$ in monomolecular layer (ml/g); (A) represents $6\times10^{23}$ (molecules/mol)); ($N_2$) represents $N_2$ specific surface area ($cm^2$), has the relationship represented by the following formula;

$$n_2/n_1 \geqq 20$$

wherein $n_1$ is the number before the particles are coated with the resin and $n_2$ is the value after the particles are coated with the resin.

8. A carrier for developing electrostatic latent images as claimed in claim 7, wherein the coating amount of the thermosetting resin is 2.7 to 3.5% by weight on the basis of the weight of the carrier core particles.

9. A carrier for developing electrostatic latent images as claimed in claim 8, wherein the coating layer is formed by repeating the processes comprising a step of coating the carrier core particles with a solution of a thermosetting resin, a step of sintering the coated particles and a step of pulverizing the sintered particles.

10. A carrier for developing electrostatic latent images as claimed in claim 9, wherein the coating layer is formed by reducing the amount of the coating resin as the number of times of coating treatment increases.

11. A carrier for developing electrostatic latent images as claimed in claim 10, wherein the amount of coating resin in the last coating process is one-half or less of the average amount of the coating resin of each coating process.

12. A carrier for developing electrostatic latent images as claimed in claim 11, wherein the last sintering process is carried out at a temperature between the sintering temperature in each sintering process and the sintering temperature plus 50° C. in each sintering process.

13. A carrier for developing electrostatic latent images comprising;

carrier core particles in which a ratio of small particles of 31 μm or less is 10 volume %, and a mean particle size is 40 to 60 μm and a bulk density is 2.45 to 2.65 g/$cm^3$, and a resin layer coating the surface of the core particles at an amount of 2.7 to 3.5% by weight on the basis of the core particles, a ratio of change of large particles having a particle size of 62 μm or more before and after coated with the resin being less than 100% when the ratio is expressed by the following formula (II):

$$(B-A)/A \qquad \text{(II)}$$

wherein "A" denotes the ratio (%) of the carrier core particles having a particle size of 62 μm or more, and "B" denotes the ratio (%) of the resin-coated carrier particles having a particle size of 62 μm or more.

14. A carrier for developing electrostatic latent images comprising;

a carrier core particles and a coating layer comprising an acrylic-styrene resin and a melamine resin which is able to cross-link the acrylic-styrene resin to form crosslinkages, the ratio of the integrated intensity between unreacted melamine components and unreacted styrene components of acrylic-styrene resin in the coating layer being in the range of 0.05 to 0.50.

15. A carrier for developing electrostatic latent images as claimed in claim 14, wherein the acrylic-styrene resin is composed of at least one kind of acrylic acid, methacrylic acid, acrylic acid esters or methacrylic acid esters having functional groups, the content of acrylic-styrene resin being 5 to 30% by weight, and the content of melamine resin being 10 to 35% by weight.

16. A carrier for developing electrostatic latent images as claimed in claim 14, wherein the surface area index of the carrier core particles is in the range of 2.2 to 5.2.

17. A carrier for developing electrostatic latent images as claimed in claim 14, which is used in combination with a toner mainly composed of polyester resins.

18. A carrier for developing electrostatic latent images as claimed in claim 17, wherein the toner is light-transmittable.

* * * * *